US007021211B1

(12) United States Patent
Shih

(10) Patent No.: US 7,021,211 B1
(45) Date of Patent: Apr. 4, 2006

(54) STAMP HOUSING ASSEMBLY

(76) Inventor: Shiny Shih, No. 31, Lane 349, Chungcheng S. Rd., Yungkang City, Tainan Hsien (TW)

( * ) Notice: Subject to any disclaimer, the term of this patent is extended or adjusted under 35 U.S.C. 154(b) by 0 days.

(21) Appl. No.: 10/964,133

(22) Filed: Oct. 13, 2004

(51) Int. Cl.
*B41K 1/36* (2006.01)
*B41K 1/00* (2006.01)
*B41K 1/02* (2006.01)

(52) U.S. Cl. ..... 101/405; 101/368

(58) Field of Classification Search ..... 101/279, 101/368, 333, 327, 405, 406; 215/216
See application file for complete search history.

(56) References Cited

U.S. PATENT DOCUMENTS 4,570,810 A * 2/1986 Hawkins ..... 215/253
4,676,162 A * 6/1987 Phipps et al. ..... 101/405
4,742,927 A * 5/1988 Tierney et al. ..... 215/216
4,991,729 A * 2/1991 Hunter ..... 215/206
5,636,569 A * 6/1997 Winston ..... 101/333
5,657,905 A * 8/1997 Glynn ..... 222/153.1
5,855,170 A * 1/1999 Shih ..... 101/327
5,974,969 A * 11/1999 Okumura et al. ..... 101/327
6,058,840 A * 5/2000 Poplawski et al. ..... 101/405
6,302,022 B1 * 10/2001 Shih ..... 101/379
6,604,643 B1 * 8/2003 Michael et al. ..... 215/204
6,685,061 B1 * 2/2004 Wolf et al. ..... 222/153.06

* cited by examiner

*Primary Examiner*—Daniel J. Colilla
(74) *Attorney, Agent, or Firm*—Alan D. Kamrath; Nikolai & Mersereau, P.A.

(57) ABSTRACT

A stamp housing assembly has a shell and a cover. The cover selectively attaches to the shell of the stamp to cover a stamp face assembly. With the shell oriented 180° relative to the cover, the cover does not attach to the shell, but can be used as a stand so the stamp will not inadvertently stain objects in the workplace and the stamp can be freely removed from the cover.

10 Claims, 5 Drawing Sheets

STAMP HOUSING ASSEMBLY

BACKGROUND OF THE INVENTION

1. Field of the Invention

The present invention relates to a stamp housing assembly that will provide a stamp that does not stain any place around it when not being used.

2. Description of Related Art

Stamps have been used as marking tools for a long time. A stamp comprises a housing and an embossed stamp face. The housing has a handle and a cover. The handle is formed on and extends out of the top of the housing. The cover is removably attached to the bottom of the housing. The embossed stamp face is attached to the bottom of the housing under the cover.

When the stamp is used, the cover is removed from the bottom of the housing. A user holds the handle of the housing and pushes the housing onto a surface that needs to be stamped. The embossed stamp face presses against the surface and prints a desired word or picture. After stamping an object, the stamp is withdrawn from the surface, and the cover is placed on the housing to keep the embossed stamp face from staining a place or a matter around the stamp.

When the stamp needs to be used again, a person holds the handle with one hand and removes the cover from the housing with the other hand. Some people find removing and replacing the cover to be too time consuming or bothersome so they do not put the cover back on the housing after the stamp is used. They put the stamp without the cover on the desk, table, counter or the like where they are working. By doing this, the stamp without the cover stains the work surface and objects on the work surface.

To overcome the shortcomings, the present invention provides a stamp housing assembly to mitigate the aforementioned problems.

SUMMARY OF THE INVENTION

The main objective of the invention is to provide a stamp housing assembly that keeps ink from the stamp staining objects in a work space and is convenient to use.

The stamp housing assembly comprises a shell and a cover. The cover selectively attaches to the shell of the stamp to cover a stamp face assembly. With the shell oriented 180° relative to the cover, the cover does not attach to the shell, but can be used as a stand so the stamp will not inadvertently stain objects in the workplace and the stamp can be freely removed from the cover.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
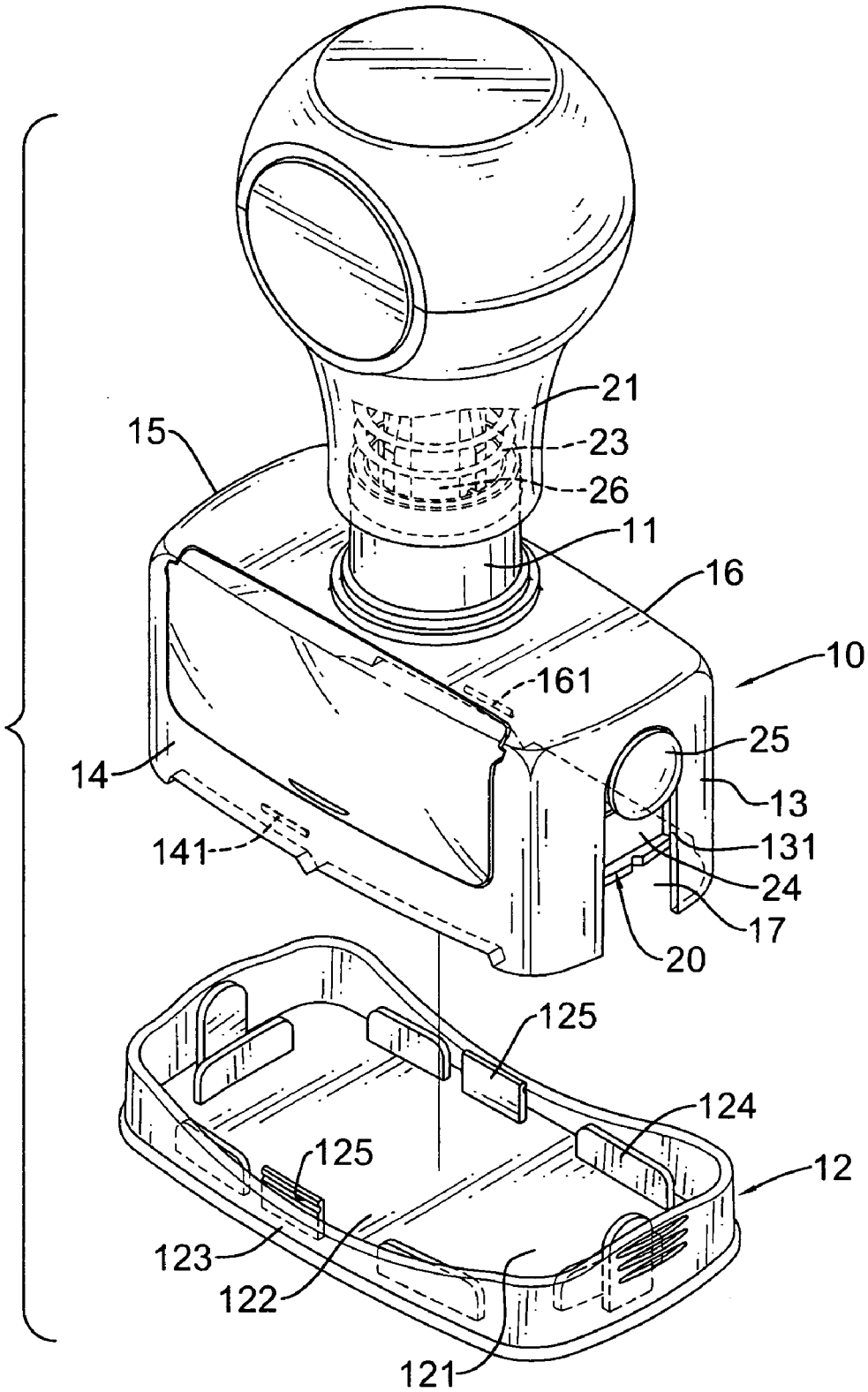
FIG. 1 is a partially exploded perspective view of a stamp housing assembly in accordance with the present invention.
Figure 2:
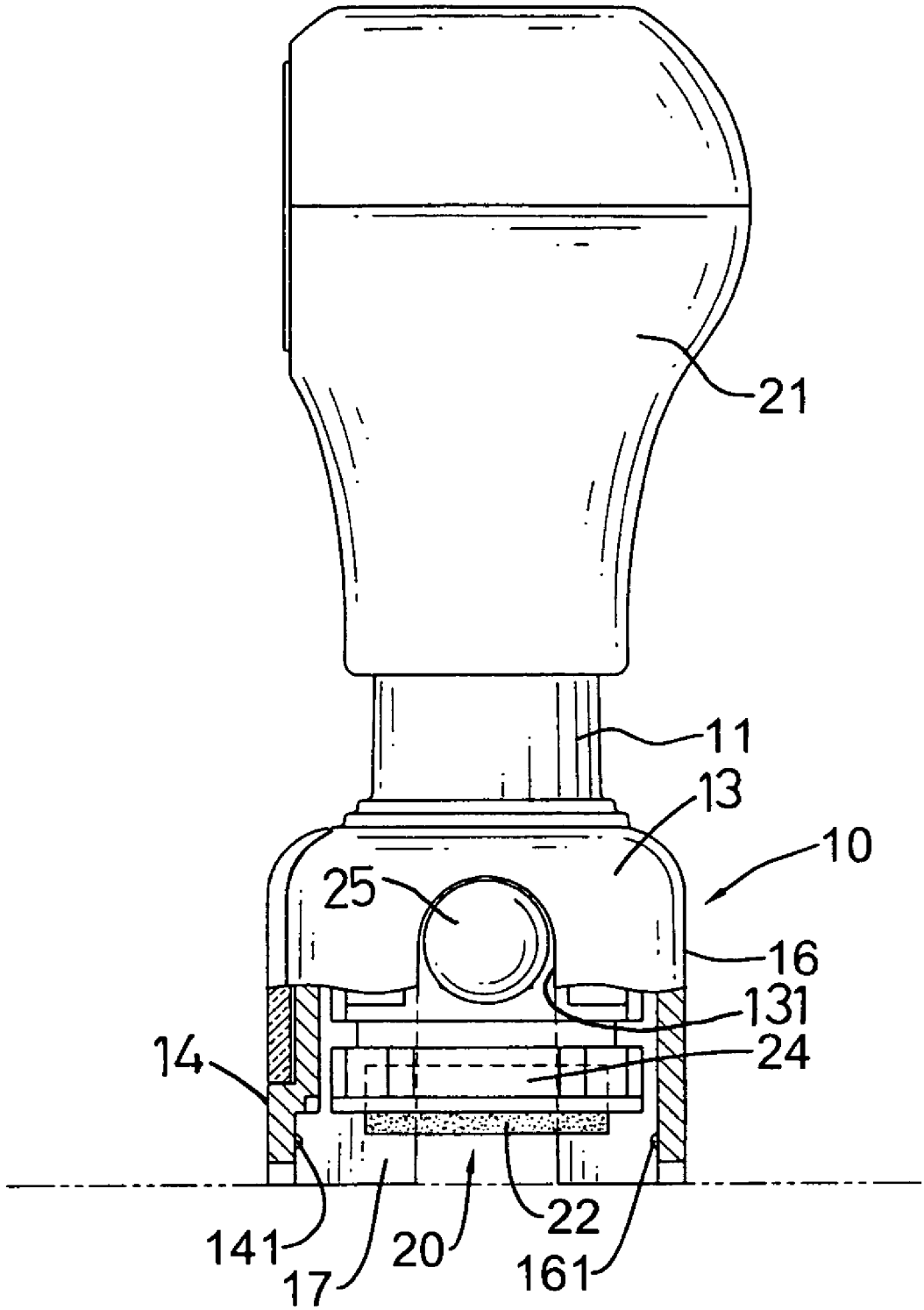
FIG. 2 is a right side view in partial section of the stamp in FIG. 1.
Figure 3:
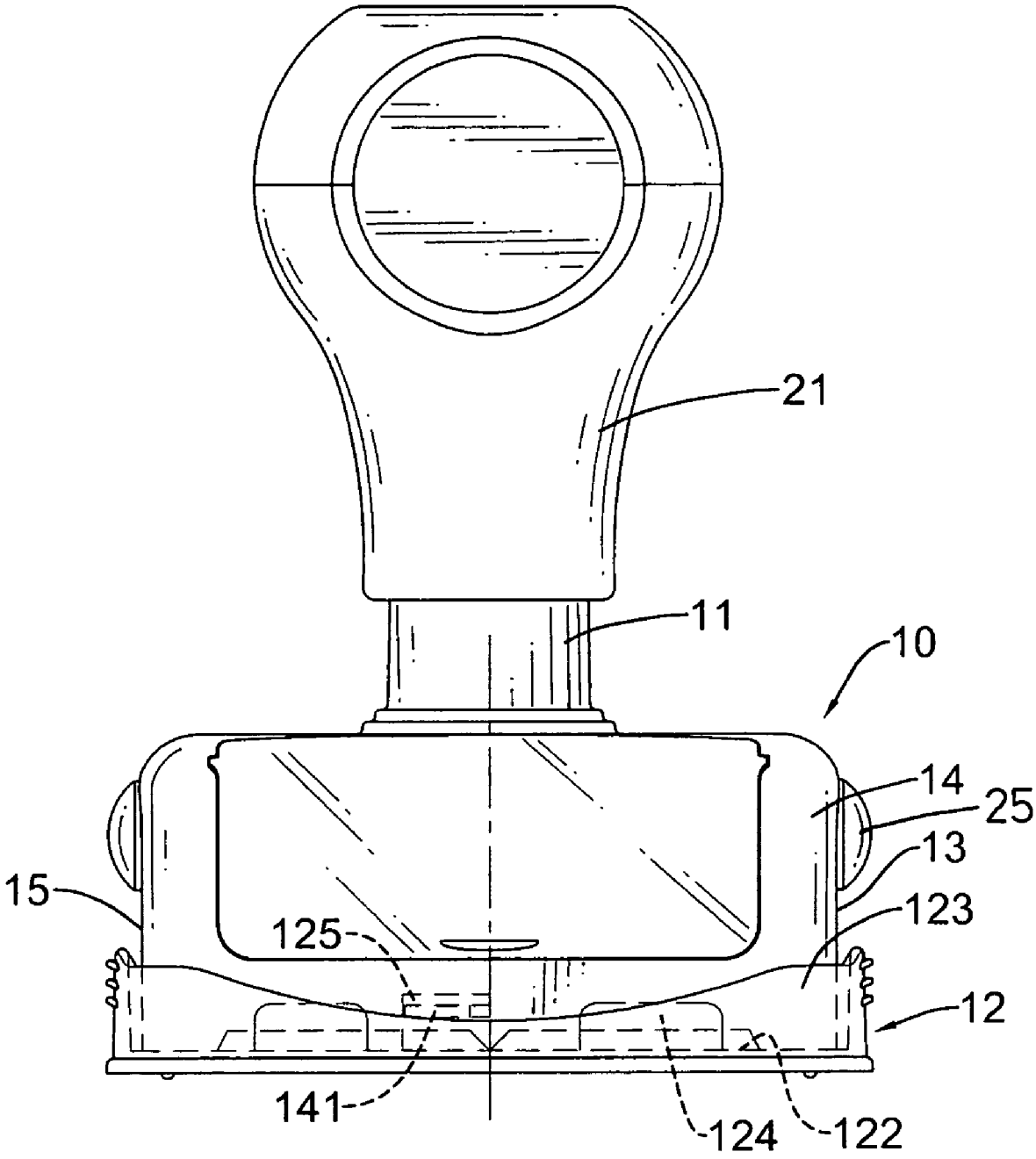
FIG. 3 is an operational front view of the stamp housing assembly in FIG. 1 with the cover securely attached to the stamp.

With reference to FIGS. 1, 2 and 3, the stamp housing assembly in accordance with the present invention comprises a shell (10) and a cover (12).

The shell (10) has a top, a collar (11), a right-side wall (13), a left-side wall (15), a front wall (14), a rear wall (16) and an open end (17). The collar (11) is hollow, is formed on and extends up from the top of the shell (10) and has a distal end. The right-side wall (13), the left-side wall (15), the front wall (14) and the rear wall (16) are formed on and extend down from the top of the shell (10) and, respectively, have bottom edges. The right-side wall (13) and the left-side wall (15), respectively, have longitudinal slots (131). The longitudinal slots (131) are formed through the right-side wall 13 and the left-side wall (15) and extend to the bottom edge. The open end (17) is located between the right-side wall (13), the left-side wall (15), the front wall (14) and the rear wall (16). The front wall (14) and the rear wall (16), respectively, have ribs (141, 161) formed in alignment with one another and transversely off-center near the open end (17) of the shell (10).

The cover (12) has an open top (121), a bottom (122), a sidewall (123), multiple alignment retainers (124) and clips (125). The bottom (122) has an inner top surface and an outer edge. The sidewall (123) is formed on and extends up from the outer edge and the inner top surface of the bottom (122) of the cover (12). The alignment retainers (124) and the clips (125) are formed on and extend up from the inner surface of the bottom (122) near the sidewall (123). The clips (125) are in alignment with one another and transversely off-center. With further reference to FIG. 3, the clips (125) selectively align with and engage the ribs (141, 161) on the front wall (14) and the rear wall (16) of the shell (10).

A stamp with a stamp housing assembly in accordance with the present invention, which can be a conventional retractable stamp, comprises the shell (10), a stamp face assembly (20), a handle (21) and a spring (23).

The stamp face assembly (20) is slidably mounted in the shell (10) and comprises a body (24), an embossed stamp face (22), two guide protrusions (25) and a neck (26).

The body (24) is slidably mounted in the shell (10) and has a top, a bottom and two ends. The embossed stamp face (22) is securely attached to the bottom of the body (24) and is located in the open end (17) of the shell (10).

Figure 4:
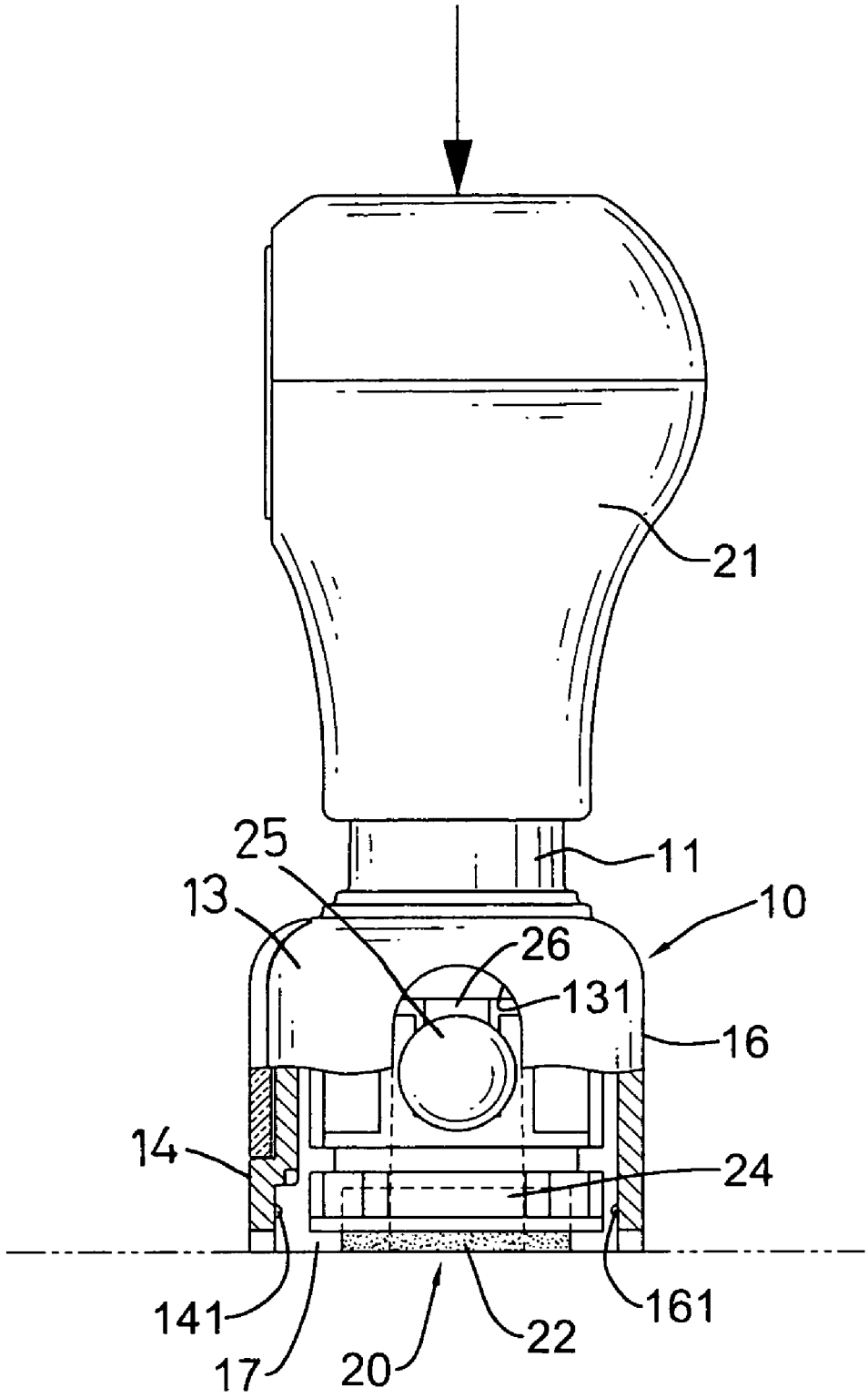
FIG. 4 is an operational right side view in partial section of the stamp in FIG. 2 with the embossed stamp face in contact with an object to be stamped.

With reference FIGS. 3 and 4, the two guide protrusions (25) are formed respectively, on the ends of the body (24) and are slidably mounted, respectively, in the longitudinal slots (131) in the right-side wall (13) and the left-side wall (15) of the shell (10).

The neck (26) is formed on and protrudes up from the top of the body (24), is slidably mounted through and protrudes from the collar (11) of the shell (10) and has a distal end.

The handle (21) is mounted slidably around the collar (11) of the shell (10) and is attached securely to the distal end of the neck (26) of the body (24).

The spring (23) is mounted around the neck (26) of the body (24) between the distal end of the collar (11) of the shell (10) and the handle (21) and presses the handle (21) up that draws the attached stamp face assembly (20) into the shell (10).

Figure 5:
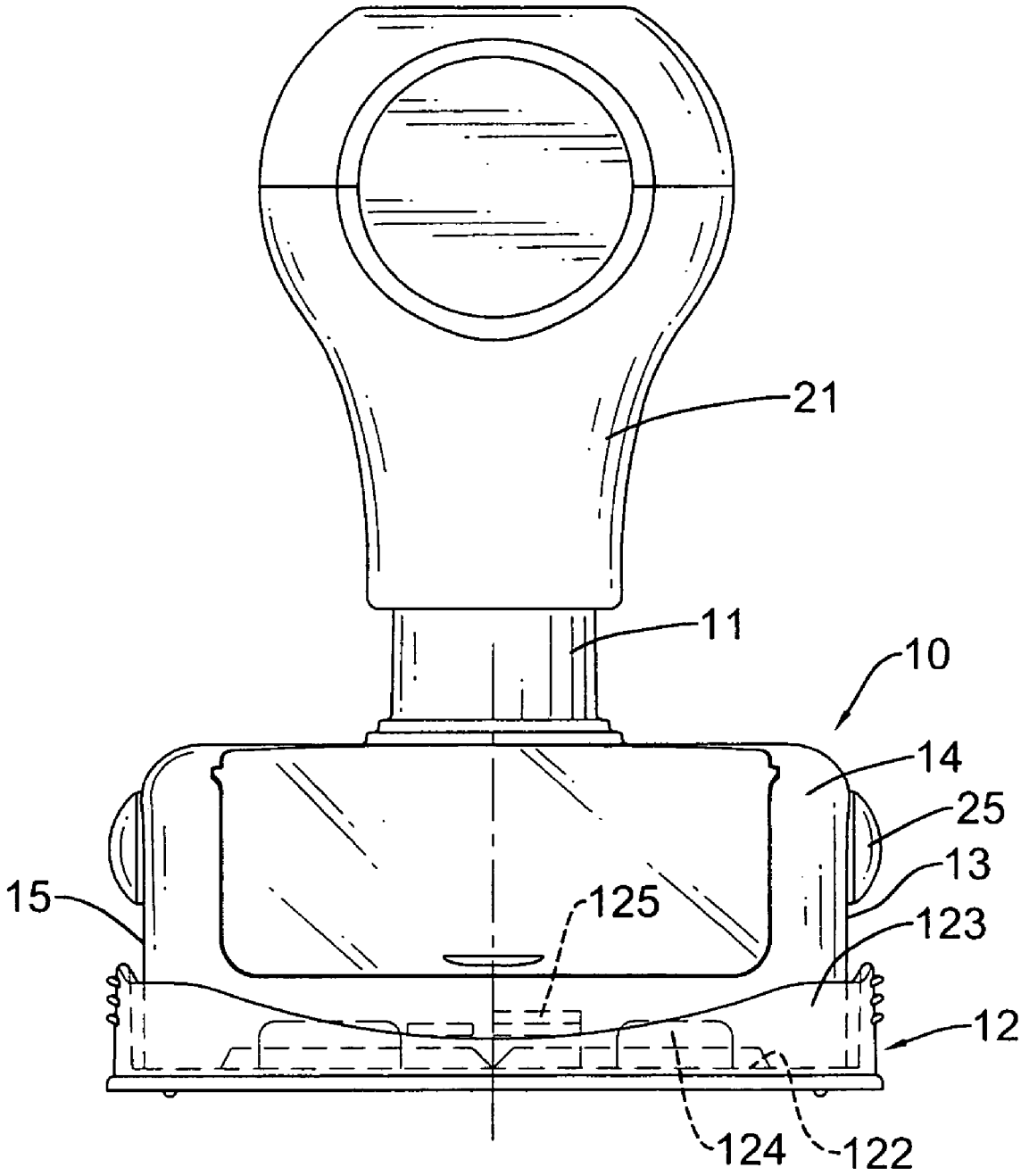
FIG. 5 is an operational front view of the stamp housing assembly in FIG. 1 in but not attached to the cover.

With further reference FIG. 5, with the off-center ribs (141, 161) and the clips (125), the ribs (141, 161) on the front wall (14) and the rear wall (16) of the shell (10) do not align with and engage the clips (125) in the cover (12) when the stamp is rotated 180°. Consequently, the stamp can be freely lifted from the cover (12) so that a user can disengage the stamp from the cover (12) without ever touching the cover (12). When not being used, the stamp sits on the top open of the cover (12), and the embossed stamp face (22) is surrounded by the shell (10) and cover (12) so that the embossed stamp face (22) will not stain anything.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A stamp housing assembly comprising a shell having a top;

a bottom;

a right-side wall formed on and extending down from the top of the shell and having a bottom edge; and a longitudinal slot formed through the right-side wall and extending to the bottom edge;

a left-side wall formed on and extending down from the top of the shell and having a bottom edge; and a longitudinal slot formed through the left-side wall and extending to the bottom edge;

a front wall formed on and extending down from the top of the shell and having a bottom edge;

a rear wall formed on and extending down from the top of the shell and having a bottom edge; and an open end located between the right-side wall, the left-side wall, the front wall and the rear wall;

a cover detachably attached to the shell and having an open top;

a bottom having an inner top surface; and an outer edge;

a sidewall formed on and extending up from the outer edge and the inner top surface of the bottom of the cover; and multiple clips formed on and extending up from the inner surface of the bottom near the sidewall;

wherein the front wall and the rear wall of the shell have ribs, the ribs are oppositely formed transversely off-center near the bottom edge of the shell; and wherein the shell is positionable relative with the cover in a stored position and a use position rotated from the stored position, wherein in the stored position, the multiple clips selectively align with and engage with the ribs on the shell such that the cover is able to enclose and attach a bottom portion of the stamp when the stamp is not in use and in the use position, the multiple clips are misaligned with and do not engage the ribs on the shell such that the cover is able to enclose the bottom portion of the stamp when the shell is received in the cover but is able to detach from the bottom portion of the stamp when the stamp is in use.

2. The stamp housing assembly as claimed in claim 1, wherein the shell has a collar, with the collar being hollow and formed on and extending up from the top of the shell; and the cover has multiple alignment retainers formed on and extending up from the inner surface of the bottom near the sidewall.

3. The stamp housing assembly as claimed in claim 2, wherein the multiple alignment retainers are spaced from the outer edge and the sidewall, with the bottom edges of the shell being received inside of the sidewall and between the sidewall and the alignment retainers when the shell is received in the cover.

4. The stamp housing assembly as claimed in claim 3, wherein the multiple clips are spaced from the outer edge and the sidewall, with the front and rear walls of the shell each having an outer surface slideably contacting the sidewall and an inner surface, with the ribs formed on the inner surface, with the outer surface located intermediate the sidewall and the ribs.

5. The stamp housing assembly as claimed in claim 4, wherein the multiple clips are spaced from the multiple alignment retainers.

6. The stamp housing assembly as claimed in claim 5, further comprising a handle slideably mounted around the collar of the shell; and a spring mounted around the collar and sandwiched between the shell and the handle.

7. The stamp housing assembly as claimed in claim 2, wherein the multiple clips are spaced from the outer edge and the sidewall, with the front and rear walls of the shell each having an outer surface slideably contacting the sidewall and an inner surface, with the ribs formed on the inner surface, with the outer surface located intermediate the sidewall and the ribs.

8. The stamp housing assembly as claimed in claim 7, wherein the multiple clips are spaced from the multiple alignment retainers.

9. The stamp housing assembly as claimed in claim 8, further comprising a handle slideably mounted around the collar of the shell; and a spring mounted around the collar and sandwiched between the shell and the handle.

10. The stamp housing assembly as claimed in claim 2, further comprising a handle slideably mounted around the collar of the shell; and a spring mounted around the collar and sandwiched between the shell and the handle.

* * * * *